US005343824A

United States Patent [19]

Floyd

[11] Patent Number: 5,343,824

[45] Date of Patent: Sep. 6, 1994

[54] REMOVABLE COVER FOR BOATS AND OTHER OBJECTS

[76] Inventor: Richard S. Floyd, 22 Bruce St., Williamston, S.C. 29697

[21] Appl. No.: 136,913

[22] Filed: Oct. 18, 1993

[51] Int. Cl.[5] ..... B63B 17/00

[52] U.S. Cl. ..... 114/361; 114/347; 135/119; 4/503

[58] Field of Search ..... 114/347, 361; 24/462; 135/119; 4/503

[56] References Cited

U.S. PATENT DOCUMENTS

| | | | |
|---|---|---|---|
| 4,520,747 | 6/1985 | Masters | 114/347 |
| 4,583,480 | 4/1986 | Hamilton et al. | 114/347 |
| 4,660,498 | 4/1987 | Madison | 114/347 |
| 4,699,076 | 10/1987 | Curtiss | 114/347 |
| 4,727,821 | 3/1988 | Masters | 114/347 |
| 4,730,568 | 3/1988 | Campbell | 114/347 |
| 4,887,626 | 12/1989 | Dalo et al. | 135/119 |
| 4,903,629 | 2/1990 | Maudlin et al. | 114/361 |
| 5,076,194 | 2/1991 | Curtis | 114/347 |
| 5,113,781 | 5/1992 | Link | 114/361 |
| 5,189,974 | 3/1993 | Masters | 114/347 |
| 5,203,055 | 4/1993 | Broadwater | 24/462 |

*Primary Examiner*—Jesûs D. Sotelo
*Attorney, Agent, or Firm*—Judith E. Garmon

[57] ABSTRACT

A fastening device for a canoe cover consists of a set of elongated, interlocking rails that frictionally engage and trap a cover that can be comprised of waterproof "spray skirt" material or nylon "pack" material. The cover, secured over the otherwise open top of a canoe, is a continuous covering, starboard to port and bow to stern, or includes coverings with seat openings, along the length of the hull. A stack of three rails comprise the preferred embodiment of the locking mechanism, with a rail base member fastening to the hull below and along the length of opposite and parallel gunwales; a rail locking member snaps on the base rail; and a rail cover having a plurality of T-node tracks similar to a mortise receives the male nodes or tenons extending outwardly from the locking member. The cover is stretched very tautly and held in a three-way lateral gripping action by the rail. The same rail system is used around the cockpit(s) to receive the spray skirt in a quick-release mechanism.

4 Claims, 2 Drawing Sheets

REMOVABLE COVER FOR BOATS AND OTHER OBJECTS

BACKGROUND AND SUMMARY

The modern canoe is a descendant of the Native American birchbark canoe and is characterized by a completely open top defined by the edge gunnels located on the top margin of the hull. Advantages to this open arrangement versus a closed-top deck boat or kayak are several: freedom of seating and movement by the occupant. Also cargo items can be carried and openly accessed in an open canoe. In addition, ease of entry and egress, in and out of the canoe, is facilitated. However, there is one obvious disadvantage inherent in the open-top canoe as compared to the relatively waterproof top deck of the kayak. That disadvantage is the susceptibility to taking on water from the topside which, in sufficient quantities, can swamp and sink the canoe or in less quantities can dampen and wet cargo.

Wet conditions manifest themselves in a variety of boating environments on such bodies of water as rivers, lakes, and coastal wet lands. Churning rivers, especially "whitewater" situations can readily lead to a swamped boat or, at least wet gear, in an open-canoe configuration. Also large waves can be occasioned, in even normally placid lakes, by quickly occurring storms, wind, or by wakes from power boats.

Thus an owner of an open-top canoe may frequently want to render his boat more uniformly seaworthy and watertight in the top dimension, above the gunwales, by employing a wave/spray cover to protect his/her gear and the boat. It is an object of the invention to provide a readily fabricated and readily removable cover having an attachment means that enables the cover to be applied to the canoe without custom fitting and sewing.

The question arises, "why buy a canoe when a kayak will solve the aforementioned 'sea-worthiness problems.'" It's true that a kayak, with its solid over-deck and spray-skirt adapted cockpit, largely solve the problem of excess water coming in from the top; however, at great cost in terms of occupant mobility, comfort, and freedom as well as cargo capacity and accessibility. U.S. Pat. No. 4,583,480 discloses an improved spray skirt retainer for fitting around the cockpit of a kayak rendering a kayak as nearly impervious to water in an inverted deck-down position as it is in an upright floating position. However there is a danger that the occupant of a kayak may have trouble pulling out from the waist-size cockpit aperture when the kayak is trapped or jammed in an inverted position and cannot readily be "rolled over" by using the paddle.

U.S Pat. No. 4,520,747 addresses this problem for providing a means whereby an egress panel in the deck is deployed allowing the kayak navigator to raise his/her knees from a sitting position and more readily escape the inverted boat. The current invention also addresses the expedited egress problem in the canoe covering adaptation by allowing the wave/spray skirt to be quickly detached.

In addition other fastening means, elaborated in the prior art, have specific structural and functional limitations. The bulbous fastening device in U.S. Pat. No. 4,583,480 requires specific sewing and custom-cover accommodations. A gripping apparatus disclosed in U.S. Pat. No. 5,203,055 does not enable a secure, interlocking grip of the cover that locks the cover in dual or triple tracks. The cover must be secure against stress of "whitewater" or other situations where tension may affect the lock Further, the fabric is easily stretched over the middle rail and the top locked thereover.

Other traditional canoe cover attachment schemes have heretofore remained problematical in their ability to adapt an open-top canoe to a more "sea worthy" embodiment.

Perhaps the most prevalent cover attachment means currently in use are snaps and cord type fasteners. A distinct disadvantage of the aforementioned is they must be adapted by cutting, sewing, and otherwise modifying a, now, custom cover unlike the current invention. Male attachment means and anchors for snaps, cords, and Velcro are commonly pop riveted or adhesive-fastened to the hull below the gunwale. The "pin point" pull of the aforementioned plurality of common cover anchors is contrasted with the even, tight, tensioning of the current invention's rail type fastening modality. An even, bilateral pull across the top of a canoe makes for a tighter more utilitarian fit over either the open interior space defined by the gunwales or over tall cargo stacked above said gunwales.

Another commonly extant attachment means for fastening canoe coverings is an elastic cord that stretches around the boat, both under and parallel to the gunwales holding, and loosely fastening, said cover against the upper hull. This elastic cord frequently is not uniform or tight enough to effect a desirable cover, particularly under sometimes violent "whitewater" conditions. The current invention strikes a perfect balance between taut positive cover tension under normal operating conditions with a quick release option occasioned by a sharp pull under emergency conditions where it is desirable to remove the cover.

In summary, the present invention is a cover attachment means whereby a canoe can be covered simply and economically by the owner without necessitating costly custom fabricating and sewing to fit. Also this novel fastening and cover means can adapt to a plurality of environments used in a variety of fashions to cover and protect specific cargo.

The current invention in its preferred embodiment consists broadly of a rail system that is a stack of three specially adapted members or components, the top two of which mechanically grip a sheet-type covering in a three-way grip. A plurality of T-shaped male nodes trap and conform the continuous edge of a covering into expandable female receiving cavities integral to the bottom of the outermost rail component. The cover fabric is captured as the expandable top rail, which includes an enlarged T-node is pressed over the two parallel T-nodes which protrude out from the middle rail. The boat covering is held uniformly taut by the bilateral pull of opposite sets of fastening rails. A bottom base rail attaches the aforementioned cover-grasping rails to the upper outside wall of the hull just below the gunwales. A permanent attachment means of the rail base component is effected by bolts, pins, long-lasting adhesive or the like to the upper outer hull.

It is an objective of the invention to obviate the need for sewing, cutting, or otherwise fitting and adapting the cover fabric to variously sized and styled custom canoes or other boats, whereby the alternative of buying pre-cut and fitted dedicated covers for each size and type of canoe is limited by high cost and scarce supply.

It is yet another object of the invention to provide an even, uniform "pull" or tension over the entire body of the covering fabric, holding it in a multiple gripping lock. This avoids the tearing, stretching, or puckering problems often associated with many "pin-point" fastening schemes and apparatus in use today.

It is still another objective of the invention to provide a general purpose cover and fastening device that can be used for, but is not limited to: pick-up truck cover fastening apparatus; camping cover adaptations; automobile and trailer covering fastenings; stored power boat cover fastening; door openings; and the like.

DETAILED DESCRIPTION OF PREFERRED EMBODIMENTS

Figure 1:
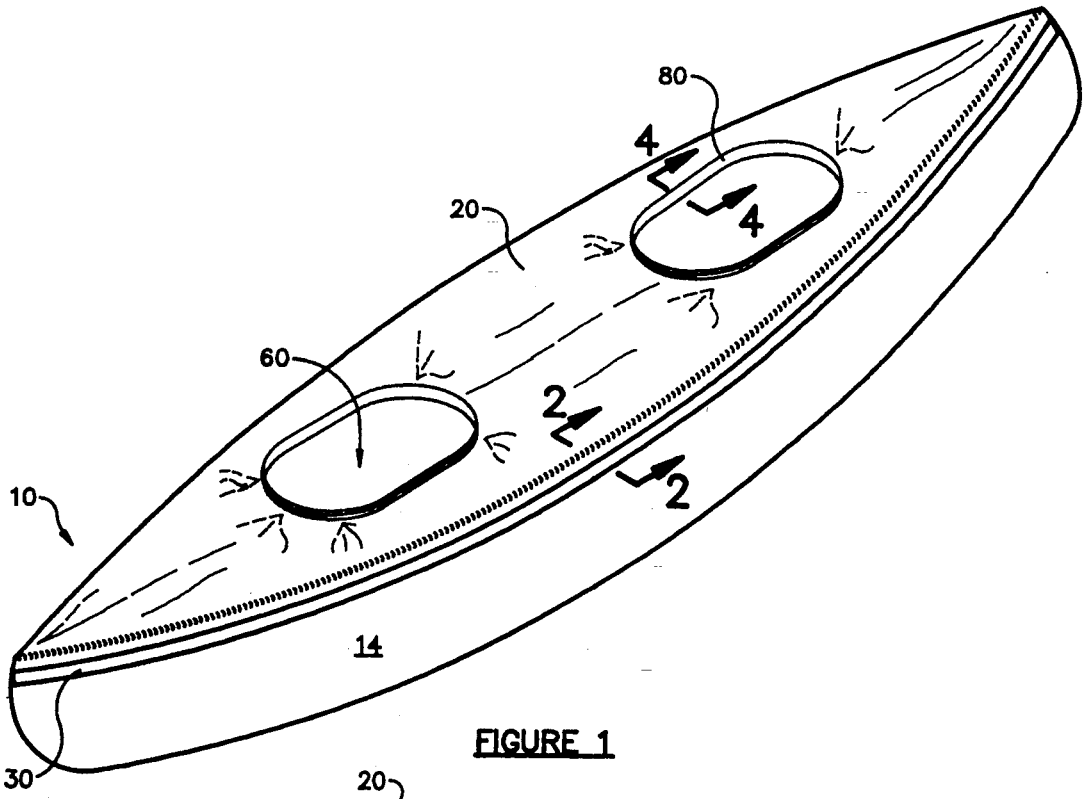
FIG. 1 is a perspective view of a canoe with a wave/-spray cover held in place by a preferred embodiment of the invention.

Looking first at FIG. 1 we can see the preferred embodiment of the canoe cover and attachment means 10 generally comprising a top covering 20 held under tension in a side-to-side pulled or stretched configuration held by the three-piece rail means 30 of the current invention. Although the cover and attachment rail described herein are disclosed as used on a canoe, the device is applicable to many environments where a removable cover is needed.

Figure 2:
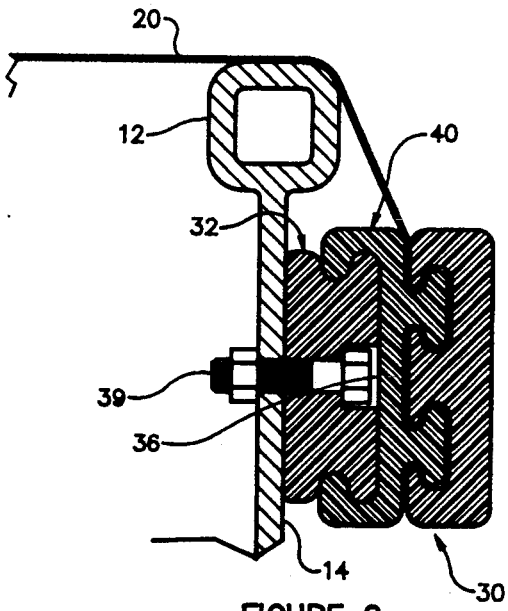
FIG. 2 is a cross-sectional view taken along lines A—A of FIG. 1.

The preferred embodiment as shown in FIG. 1, is shown in partial cross-section in FIG. 2. The gunwale 12 (generally shown in broken lines in FIG. 1) of the canoe includes, on the outer surface thereof, a rail attachment means 30 with the cover 20 locked therein. The cover 20 itself is a body of sheet material, having overall dimensions sufficient to overlap the canoe or other body being covered, extending well below the rail attachment means 30. Cover 20 thicknesses vary according to material used such as woven nylon or plasticized/rubberized spray skirt cloth. Top, middle and base components can be variously manufactured according to desired weight and internal dimension to accommodate various weights and thicknesses 20.

Materials used to manufacture the rail attachment means 30 of the present invention include extruded anodized aluminum or, alternatively, extruded plastics.

The affixment of the preferred embodiment as it secured a cover 20 across the open top of a canoe includes the grasping of one side of a covering 20 drawn taut across the outer edge of gunwale 12. The cover 20 is then placed over the protruding middle rail, and locked under a cover component which is the top rail member. The cover is held firmly within the interlocking cavities of the rail as described below.

Figure 3:
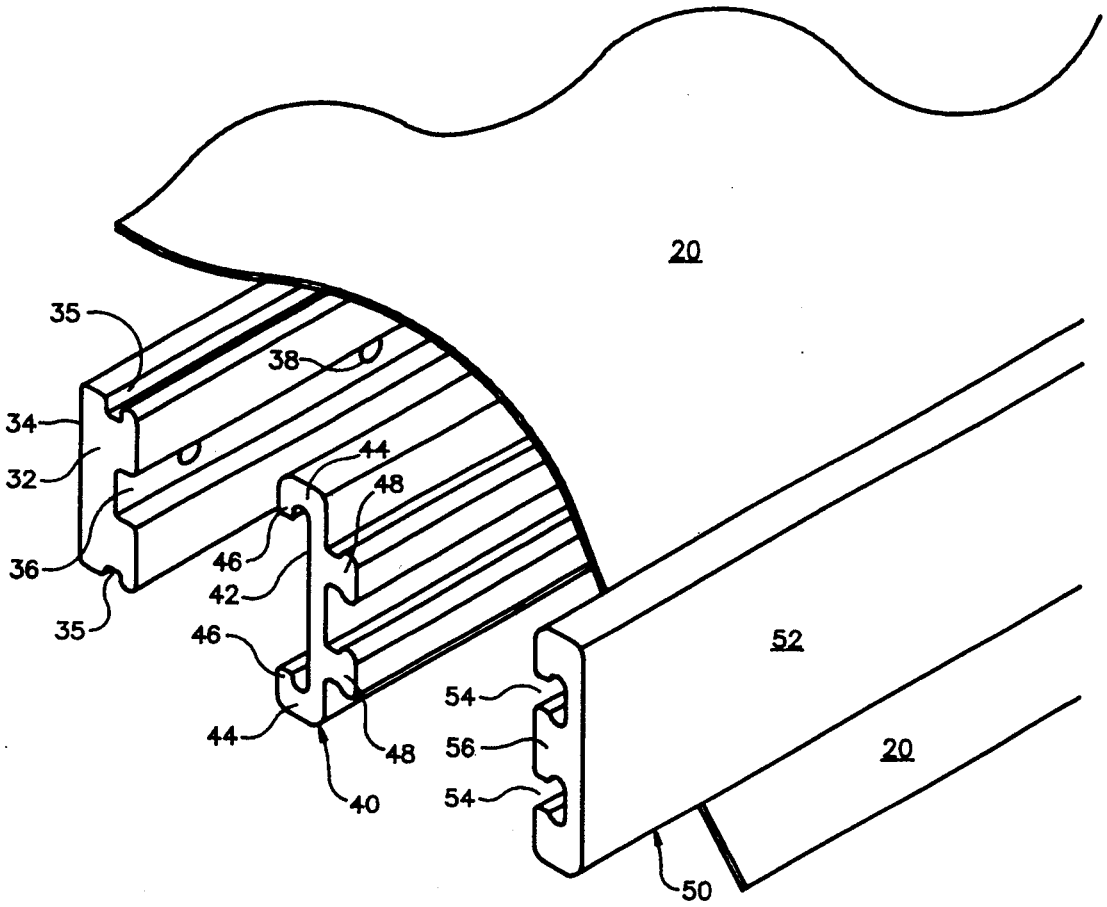
FIG. 3 is an exploded perspective view with parts broken away of the preferred embodiment of the cover and attachment rail.

The rail attachment means 30, in a preferred embodiment includes a base component 32 which is attached just under the gunwale 12 of the canoe, on the outer surface 14. Looking at both FIGS. 2 and 3, the base component 32 is an elongated, preferably extruded piece having a flat outer surface 34 that fits flatly against the canoe wall, and a forwardly disposed channel 36, basically U-shaped, with a plurality of spaced apertures 38 tapped therethrough. The apertures 38 extend through the body wall of base 32, and receive a bolt 39, therethrough. The head of bolt 39 (shown only in FIG. 2) lies in channel 36 where it does not interfere with the overlying component 40.

Component 40 is a middle rail or locking member which snaps over the base member 32 by means of an enlarged open track 42 which extends the length of the rail, and which is defined by opposing sidewalls 44 that depend rearwardly toward the canoe. These sidewalls 44 have some lateral flexibility that enable them to be snapped around the outer edges of base 32 such that the inwardly faced flanges 46 are lodged in the oppositely positioned, outer troughs 35 of base 32. The flexibility of walls 44 and the body of middle locking rail 40 should be such that the flanges 46 and walls 44 can be flexed enough to easily lock into troughs 35, but with sufficient tension to hold the component securely in place.

On the outer face of middle rail 40 are a pair of parallel, spaced T-nodes 48, much like the tenons used in wood construction, which extend outwardly for the full length of the rail. These male T-nodes 48 lie under the cloth cover 20 when emplaced, and are locked into the female receivers described below.

Holding the cover 20 in position is an outer rail component 50 that snaps over middle component 40, locking the cover 20 therebetween. The outer component 50 is configured oppositely to that configuration of base 32, having a flat outer surface 52 which faces away from the canoe or other object being covered, when properly positioned. The inner surface of component 50 is comprised of spaced, parallel, female tracks 54 which receive the correspondingly configured T-nodes 48. Between the tracks 54 is an enlarged T-node 56 which snaps into the female channel 49 that is defined by the parallel T-nodes 48. This arrangement thereby provides three T-nodes which individually grip the cover to hold it securely.

As previously described related to sidewalls 44 of the middle component 40, the flexibility of all components of the rail 30 must be such that the interlocking parts flex sufficiently to engage with each other. The resulting tension, however, must be sufficient to hold all components, with cover 20 therein, locked securely together.

Figure 4:
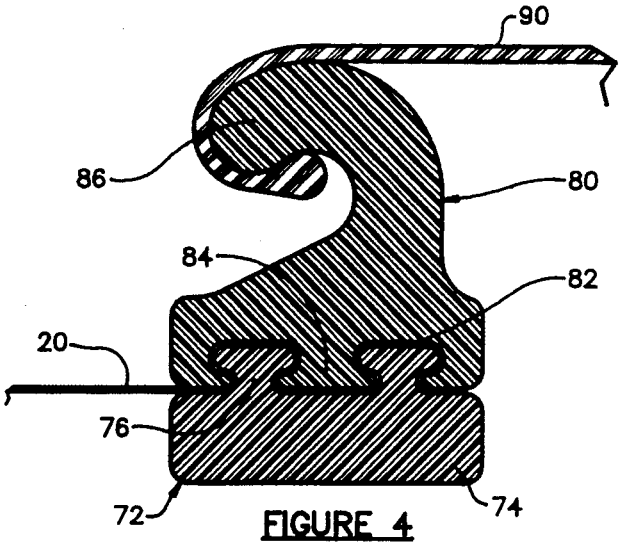
FIG. 4 is a cross-sectional view of the spray-skirt attachment, taken along lines B—B of FIG. 1.

Looking next at FIG. 4 the details of the cockpit 60 are shown in cross-section. The cockpit 60 is defined by substantially oval cutouts made in the face of cover 20 to allow the person or persons to enter the canoe. A modified rail arrangement is used to secure and support the cover 20 at the cockpit. The modified cockpit rail 70 includes a base rail 72 which underlies the cover 20 and which has a flat undersurface 74 and an upper surface with parallel T-nodes 76 much as described at element 48 (of FIGS. 2 and 3). The T-nodes 76 lock into parallel female tracks 82 in the upper component.

The upper component is generally comprised of a cockpit ring 80 having the female tracks 82 on the lower surface, an enlarged T-node 84 defined by the tracks 82, and an upwardly extending, outwardly arcuate hook member 86. The hook member 86 is utilized to receive the outer, elasticized or gathered edge of a conventional spray skirt (not shown). Spray skirts are well known and are used to protect the occupant from wetness, generally below the waist. Most are neoprene and are purchased separately from boat covers and other equipment. U.S. Pat. Nos. 4,583,480 and 4,520,747 describe conventional spray skirts.

In an emergency situation, the occupant merely grasps the edge of the spray skirt from under the hooked member 86 and pulls it off. The person may then jump from the canoe to safety. The spray skirt of course remains around the waist of the person. The cover 20 and cockpit ring 80 remain intact on the canoe and are recovered, usually without any damage.

As mentioned above, while designed originally for use with a canoe, the cover device is applicable to many environments. It can be used on many other types of boats, on trucks, even around doorways and such. It is useful anywhere a removable cover is needed. Depending upon the sheet material used to form the cover, it may be waterproof and, to varying degrees, windproof.

The advantages to this type of cover are many. First, no cutting, fitting or sewing expertise is needed. No patterns for designing or cutting are required. Because there is little cutting, and no sewing, there are no expensive machines or labor requirements.

Parts may be economically warehoused, including bolts of selected sheet materials, and the rail components. When an order is placed it is merely a matter of cutting an appropriate length and width of material, and selecting the appropriate length and quantity of interlocking rail. This substantially reduces labor and inventory costs, along with reducing shipping cost.

Upon receipt of a kit which includes rails and fabric, a person attaches the rail along the outer edges of the canoe, stretches the fabric taut, and locks the rail thereover. Excess fabric is then trimmed away. The cockpit ring is locked into position and the inner fabric trimmed away. With a purchased spray skirt the person is ready to utilize the covered canoe.

While a preferred embodiment has been explained, it is recognized that other and further modifications may be made while remaining within the scope of the claims below.

What is claimed is:

1. A detachable cover device for boats and other objects; said detachable cover device including:

A) a cover member formed of a piece of flexible sheet material having length and width dimensions sufficient to extend beyond the outer perimeters of the area to be covered;

B) an attachment means having an elongated locking rail for securing said cover member over the area to be covered; said elongated locking rail including:

a) a base component for mounting around the perimeter edges of the area to be covered; said base component having:

i) a flat undersurface for fitting flush against the surface to which it is to be mounted;

ii) opposite said flat surface, an outer face having an elongated U-shaped track defined by opposing side walls and extending the length of said rail; said U-shaped track having a plurality of apertures spaced apart along the bottom of said U-shaped track for receiving a selected fastener means therethrough;

b) a middle, locking rail having a first, rearwardly oriented face including a channel extending the length thereof for receiving said outer face of said base component securely therein; said middle locking rail further including a second, outwardly oriented face having a pair of spaced, parallel T-nodes extending outwardly therefrom, and an intermediate elongated channel defined by said parallel T-nodes;

c) an outer, cover rail having a flat outer face, and an inward face having spaced, parallel tracks for receiving said parallel T-nodes therein; said inward face further including a centrally oriented, enlarged T-node defined by and extending between, said parallel tracks, for engagement in said elongated channel on said second face of said middle, locking rail;

C) said cover member being gripped between the multiple interlocking surfaces of said middle and said outer rails; forming a substantially waterproof cover device for boats and other objects.

2. A detachable cover device according to claim 1, further including means for defining a cockpit area in a canoe; said means for defining a cockpit including:

A) a cockpit having a prescribed arcuate shape;

B) a cockpit ring including a quick-release means for holding a conventional spray skirt over said cockpit ring, such that the spray skirt may be quickly disengaged in the event of an emergency;

C) an interlocking rail means for attaching said cockpit ring to said cover member.

3. A detachable cover device according to claim 2 wherein said interlocking rail means includes:

A) said cockpit ring having an undersurface, and said undersurface having at least one female receiver formed therein;

B) an underlying locking ring, positioned underneath said cover member; said underlying ring having a first top face and a second bottom face; said top face including at least one male protrusion thereon for engagement into said female receiver in the undersurface of said cockpit ring;

whereby said cover member is engaged between said cockpit ring and said underlying locking ring; and the portion of said cover member within said cockpit ring is cut away to permit occupant ingress.

4. A detachable cover device according to claim 3 wherein said quick-release means for holding a spray skirt is comprised of:

A) said cockpit ring having an upwardly projecting hook member depending upwardly from said undersurface;

B) said projecting hook member having an open side facing outwardly from said cockpit, and said hook member receiving the outer edge of the spray skirt releasably thereover.

* * * * *